US011279018B2

(12) United States Patent
Siegman

(10) Patent No.: US 11,279,018 B2
(45) Date of Patent: Mar. 22, 2022

(54) TOOL HEAD CLAMPING SYSTEM

(71) Applicant: Saul Siegman, Lakewood, NJ (US)

(72) Inventor: Saul Siegman, Lakewood, NJ (US)

( * ) Notice: Subject to any disclaimer, the term of this patent is extended or adjusted under 35 U.S.C. 154(b) by 0 days.

(21) Appl. No.: 17/062,721

(22) Filed: Oct. 5, 2020

(65) Prior Publication Data

US 2021/0023692 A1 Jan. 28, 2021

Related U.S. Application Data

(63) Continuation-in-part of application No. 16/353,477, filed on Mar. 14, 2019, now abandoned.

(60) Provisional application No. 62/645,234, filed on Mar. 20, 2018.

(51) Int. Cl.
*B25G 3/12* (2006.01)
*A46B 5/00* (2006.01)

(52) U.S. Cl.
CPC ..... *B25G 3/12* (2013.01); *A46B 5/0095* (2013.01)

(58) Field of Classification Search
CPC ..... B25G 3/12; A46B 5/0095; A47L 13/257; A47L 13/12; A47L 13/14; A47L 13/46; A47L 13/146
USPC ..... 15/176.1, 119.1, 119.2, 116.2, 114
See application file for complete search history.

(56) References Cited

U.S. PATENT DOCUMENTS 5,488,750 A * 2/1996 Vosbikian ..... A47L 13/12 15/118

* cited by examiner

*Primary Examiner* — Monica S Carter
*Assistant Examiner* — Katina N. Henson
(74) *Attorney, Agent, or Firm* — Stuart M. Goldstein

(57) ABSTRACT

A tool head clamping system allows for the interchangeability of various cleaning tool head accessories. These accessories are connected by a clip assembly to a mop handle or like elongated hand tool handle. The system utilizes a novel male clip member to female clip member connection, with the female clip member located on the end of the elongated tool handle, and a tool head accessory consisting of the male clip member configured to have a variety of cleaning elements.

9 Claims, 12 Drawing Sheets

TOOL HEAD CLAMPING SYSTEM

RELATED APPLICATION

This application is a continuation-in-part of application Ser. No. 16/353,477, filed on Mar. 14, 2019, and also claims the benefit of provisional application Ser. No. 62/645,234, filed on Mar. 20, 2018.

BACKGROUND OF THE INVENTION

There are numerous manually operated cleaning tools e.g. mops, brooms, scrappers, shovels, etc., having elongated handles. However, to accomplish the varied cleaning functions for which these tools are used, money must be spent to purchase each individual tool. While there currently are some handled cleaning tools which have interchangeable heads, very few are available for use with more commonly used cleaning tools like brooms and mops. And there are no tool head clamping systems which effectively allow for the attachment of a variety of cleaning tool head accessories to handles, while also allowing for the accessories to be quickly and easily attached and detached from the handles.

SUMMARY OF THE INVENTION

It is thus the object of the present invention to provide a Tool Head Clamping System which overcomes the limitations and disadvantages of existing interchangeable cleaning tool head accessory systems.

These and other objects are accomplished by the present invention, a unique tool head clamping system which allows for the interchangeability of various cleaning tool head accessories. These accessories are connected by a clip assembly to a mop handle or like elongated hand tool handle. The system utilizes a novel male clip member to female clip member connection, with the female clip member located on the end of the elongated tool handle, and a tool head accessory consisting of the male clip member configured to have a variety of cleaning elements.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
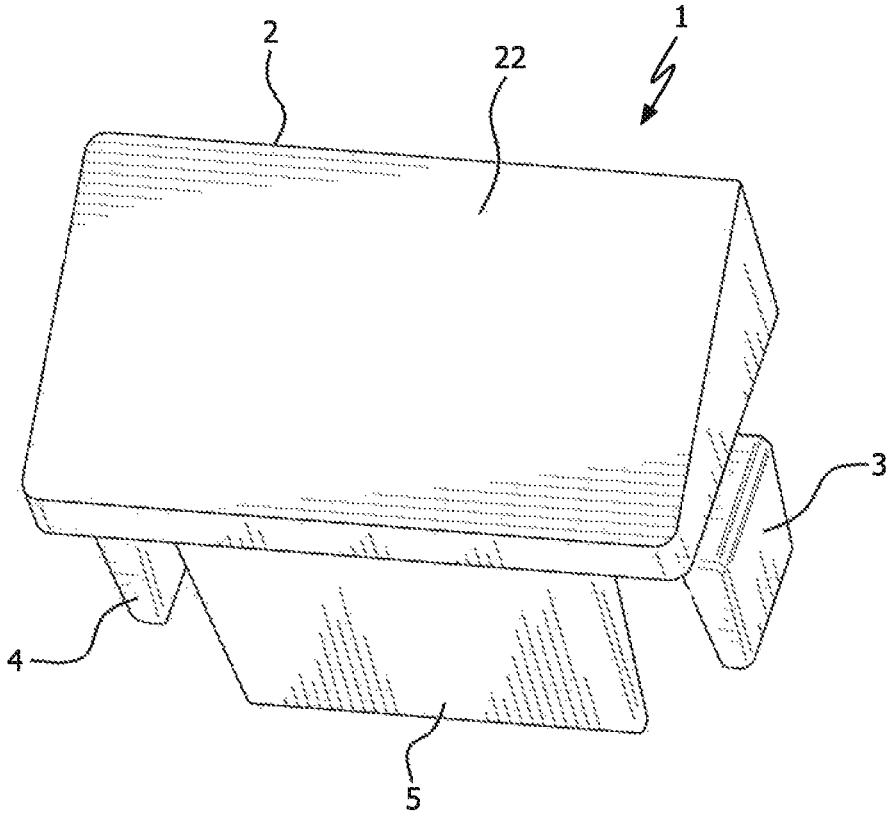
FIG. 1 is a perspective front view of the male clip member of the present invention.
Figure 2:
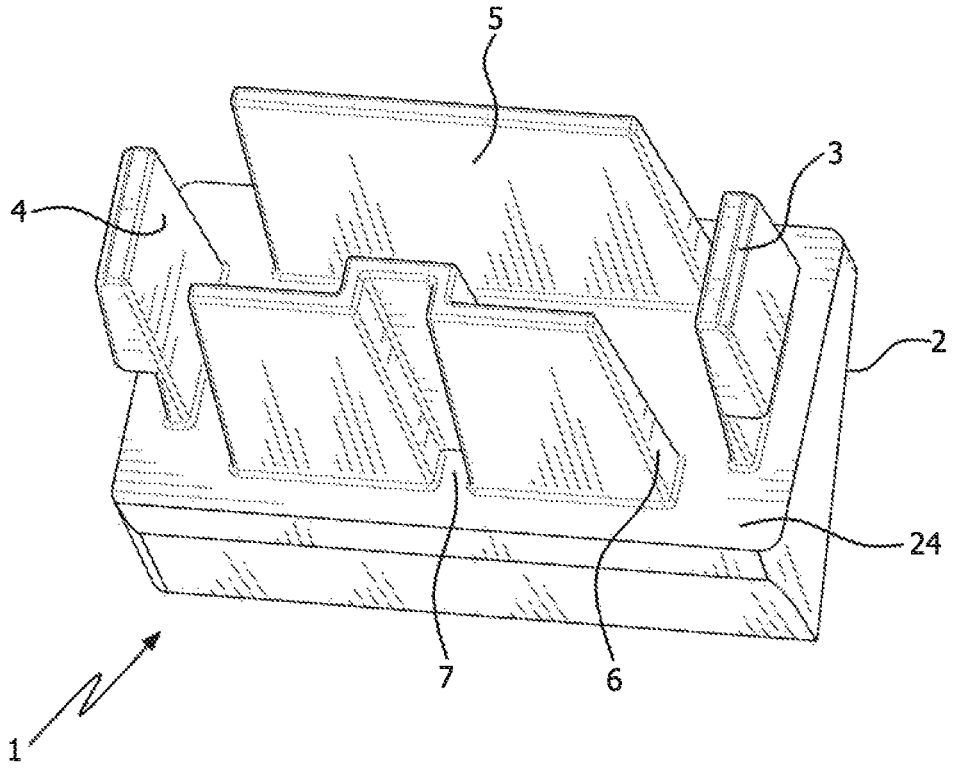
FIG. 2 is a perspective rear view of the male clip member of the present invention.

The tool head clamping system of the present invention comprises male clip member 1, best shown in FIGS. 1 and 2, having main body section 2, resilient lateral tabs 3 and 4, front wall 5, rear wall 6, and slot 7 inset within the rear wall, the front wall being positioned parallel to the rear wall.

Figure 3:
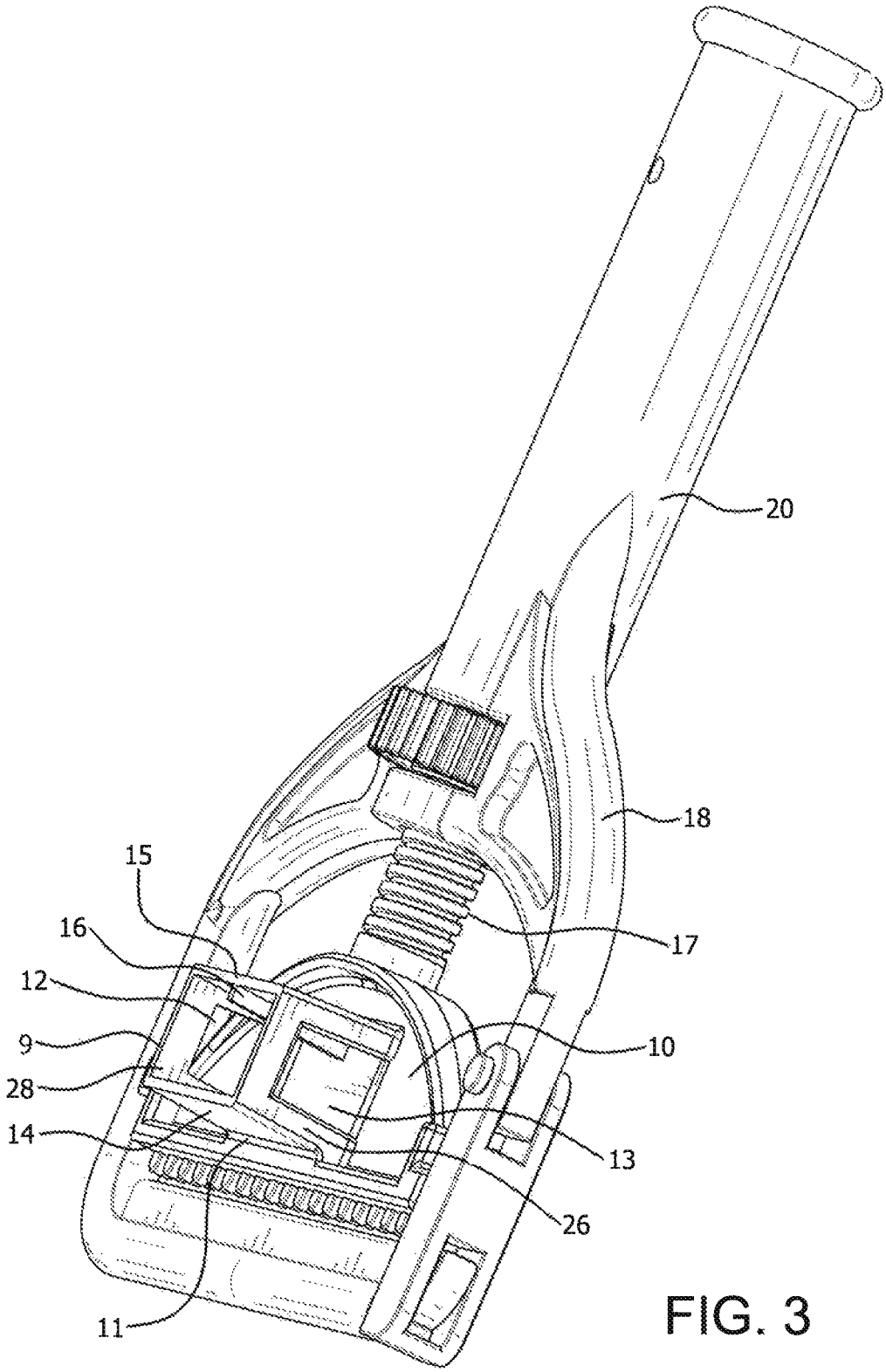
FIG. 3 is a perspective view of the female clip member of the present invention secured to the distal end of a cleaning tool handle.
Figure 4:
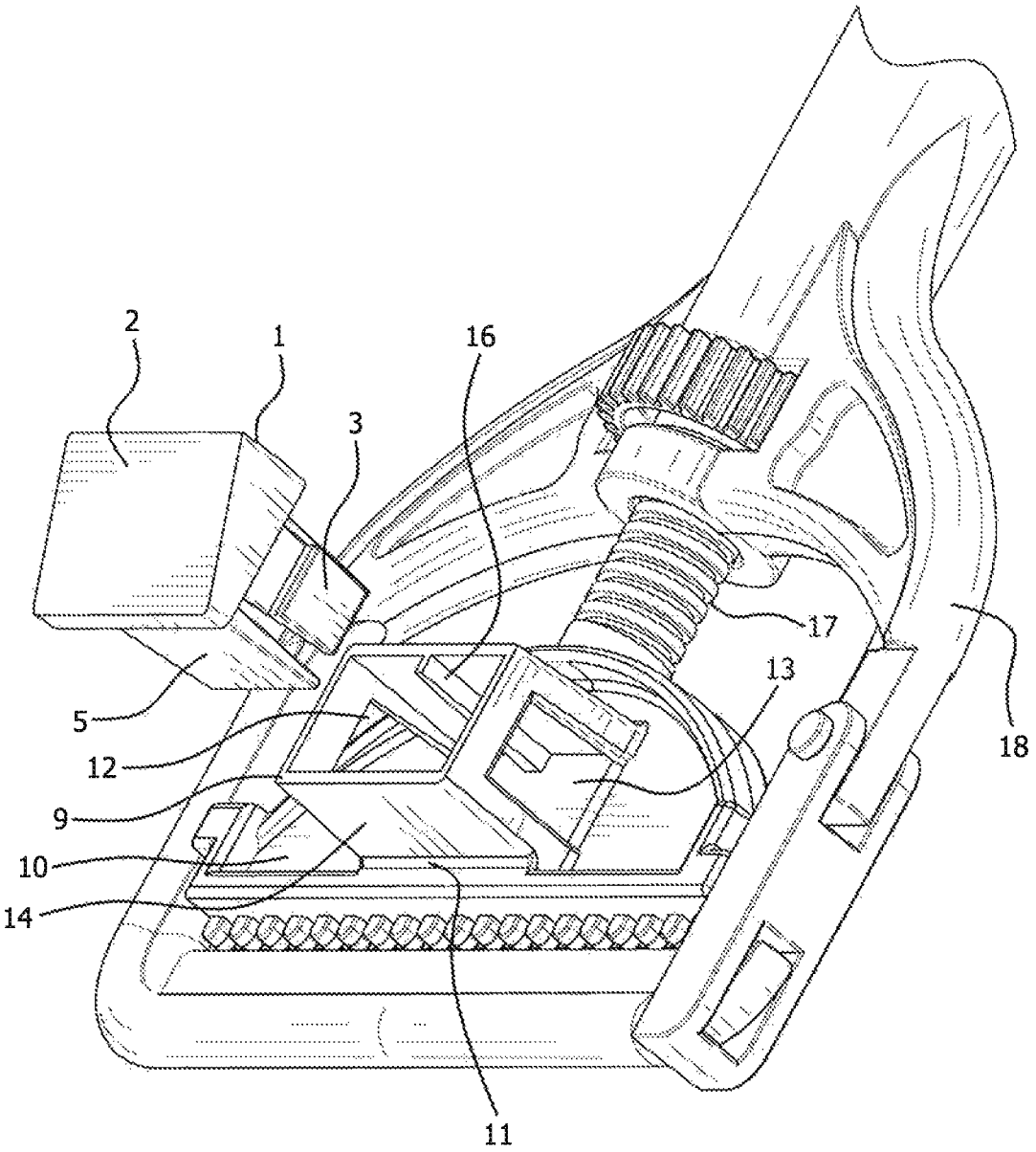
FIG. 4 is a blow-up, perspective view of the distal end of a cleaning tool handle, with the male clip member positioned for insertion into the female clip member.

Female clip member 9, best shown in FIGS. 3 and 4, comprises base 10 and upstanding frame member 11 having lateral windows 12 and 13, front wall 14 and rear wall 15. Tab 16 extends from rear wall 15. Base 10 of female clip member 9 is attached to distal end 17 of elongated tool handle 20. Yoke member 18, circumscribing female clip member 9, is attached to handle 20.

Figure 5:
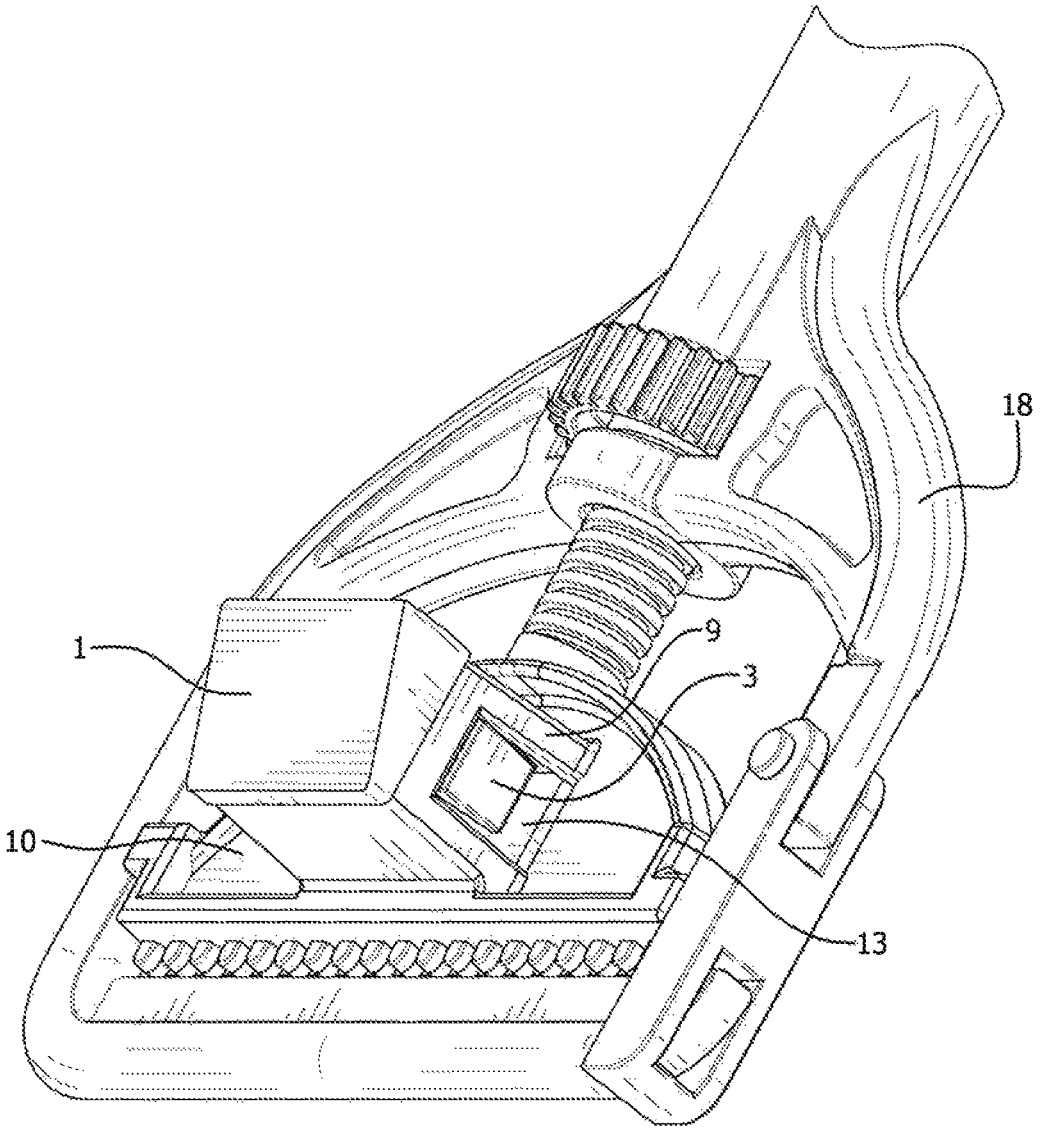
FIG. 5 is a perspective view of the distal end of a cleaning tool handle, with the male clip member attached within the female clip member.
Figure 6:
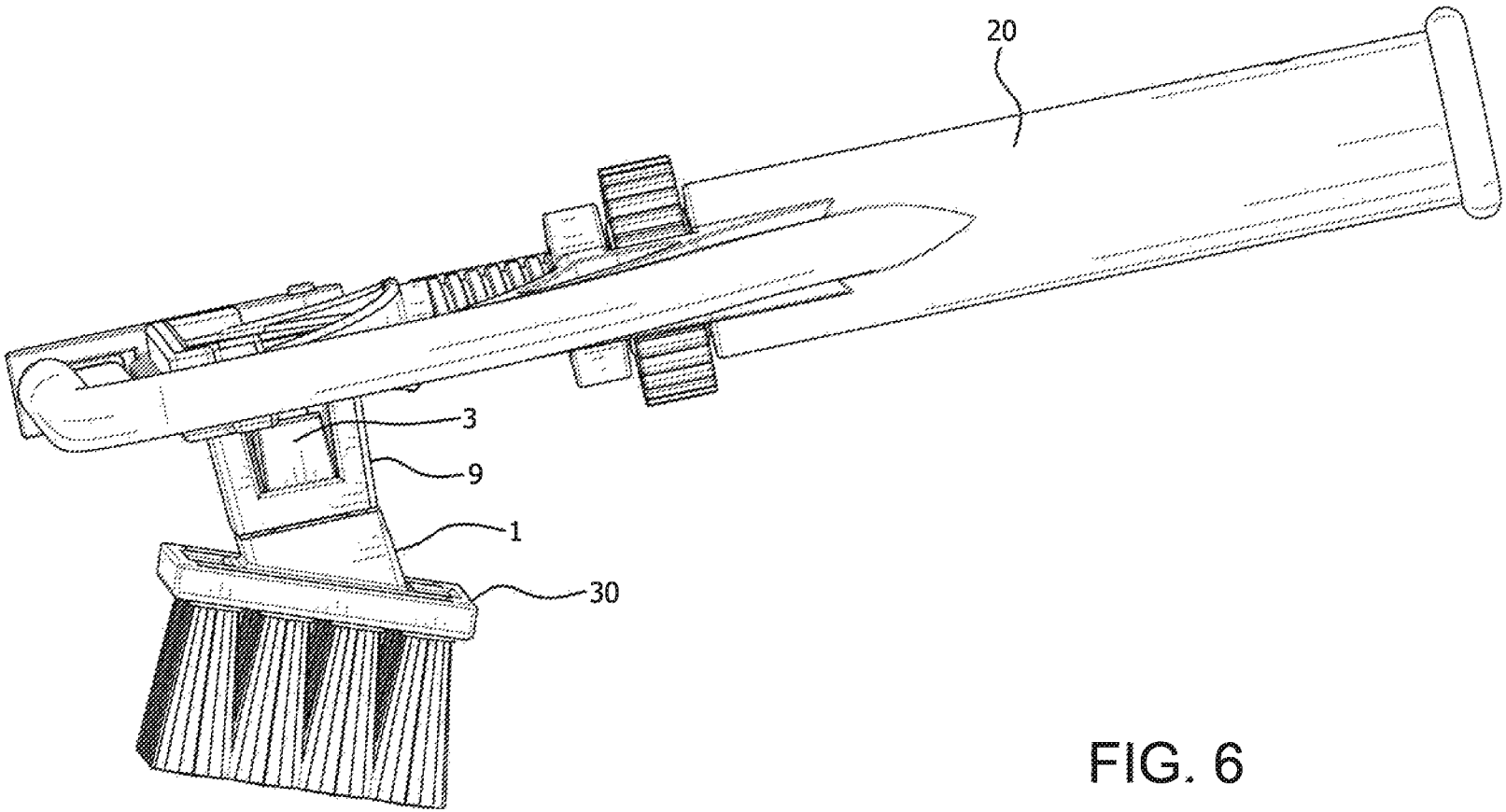
FIG. 6 shows the tool head clamping system of the present invention utilized with a cleaning element, scrub brush bristles.
Figure 7:
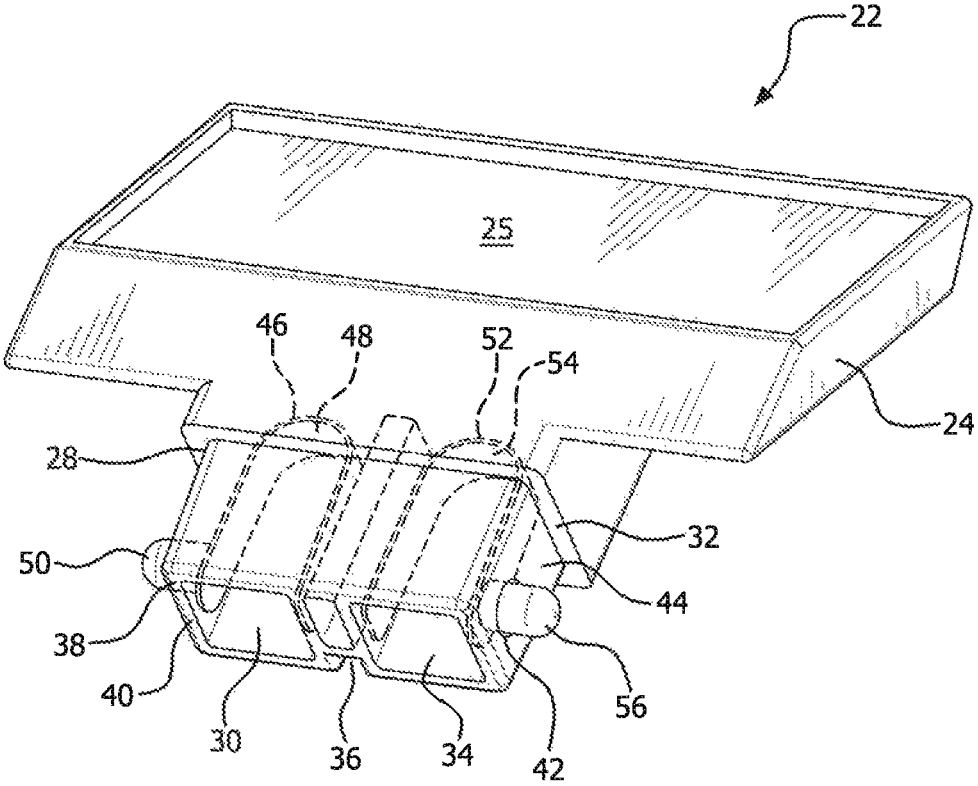
FIG. 7 is a perspective bottom view of a second embodiment of the male clip member of the present invention.
Figure 8:
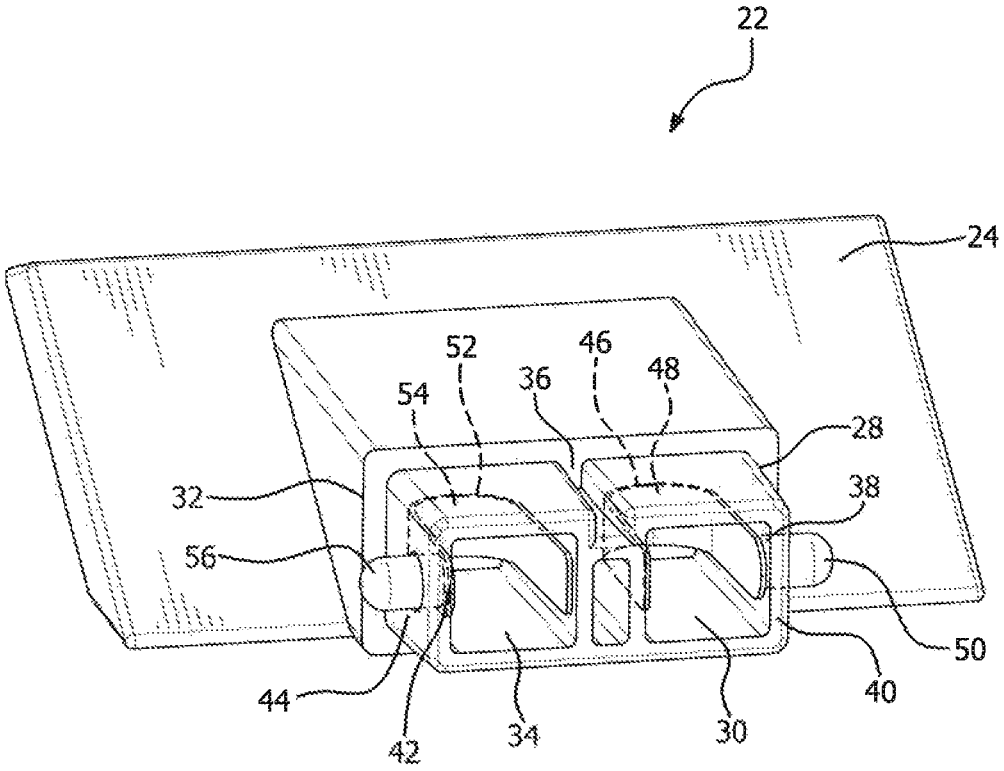
FIG. 8 is a perspective front view of the male clip member of the second embodiment of the present invention.
Figure 9:
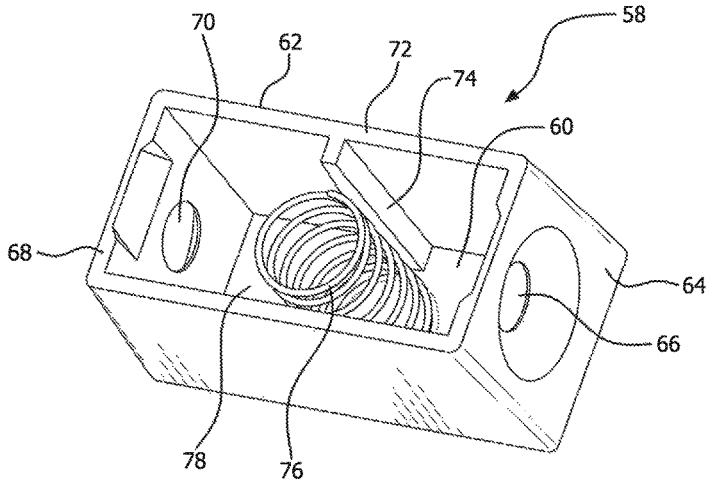
FIG. 9 is a perspective front view of the female clip member of the second embodiment of the present invention.
Figure 10:
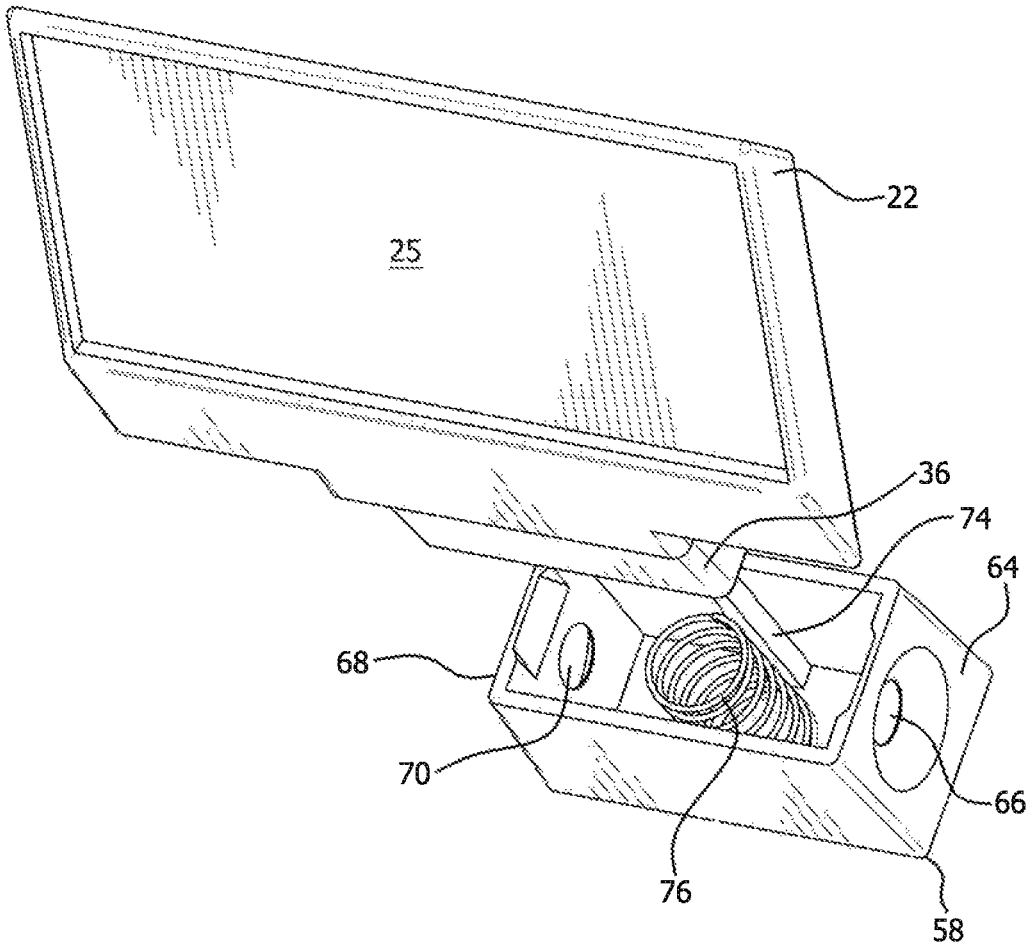
FIG. 10 is a perspective view of the male clip member of the second embodiment positioned for insertion into the female clip member of the second embodiment.
Figure 11:
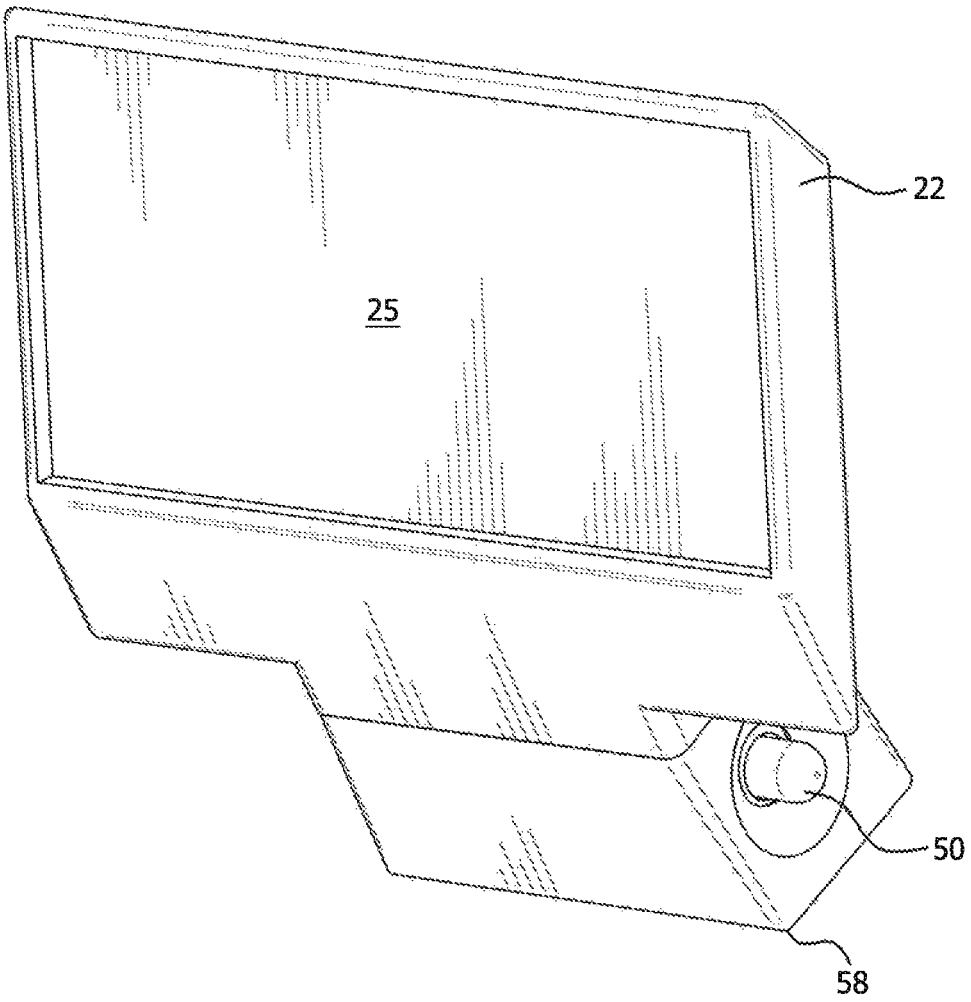
FIG. 11 is a perspective view of the male clip member of the second embodiment attached within the female clip member of the second embodiment.

As best seen in FIGS. 4 and 5, male clip member 1 is configured to be inserted into frame member 10 of female clip section 9, by pushing resilient tabs 3 and 4 inward and inserting the male clip member into the frame member such that the tabs are positioned within the lateral windows 12 and 13. The resiliency of tabs 3 and 4 allows them to be pushed inward and then spring outward into lateral windows 12 and 13. In this position, front wall 5 of male clip member 1 rests on the inner surface of front wall 14 of the female clip section, and tab 16 of the female clip member fits snugly within slot 7 of rear wall 6 of the male clip member.

Figure 12:
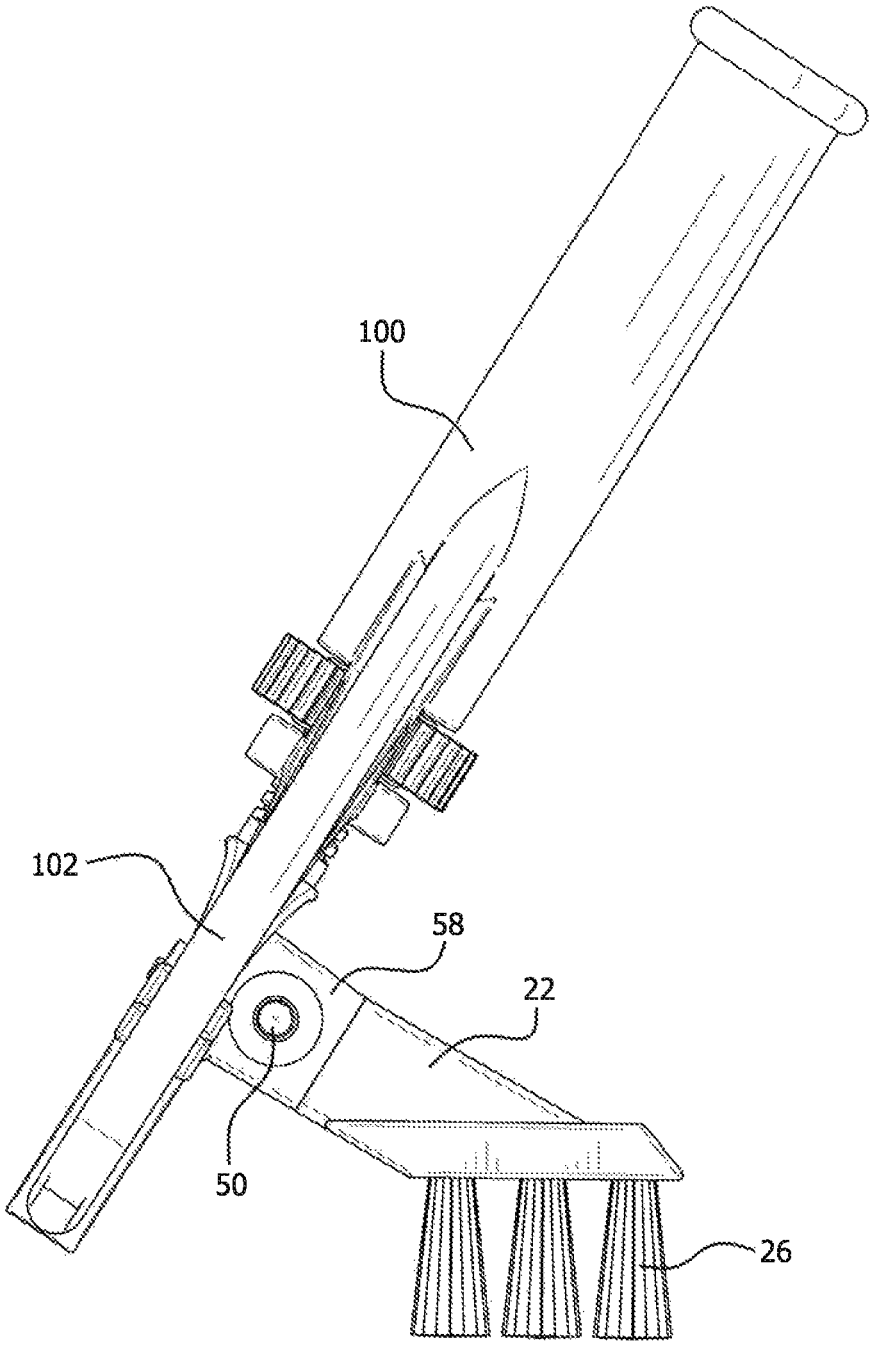
FIG. 12 shows the tool head clamping system of the second embodiment of the present invention utilized with a cleaning element, scrub brush bristles.

FIGS. 7-12 show another embodiment of the tool head clamping system of the present invention. Male clip member 22 comprises main body section 24 with bottom surface 25 on which outwardly extending cleaning elements 26, e.g. scrub brush bristles as shown in FIG. 12, are located. Main body section 24 has adjacent housings 28 and 32 with channels 30 and 34 respectively which extend out from the main body section. Slot 36 is located between housings 28 and 32 and their channels 30 and 34. Opening 38 extends through side wall 40 of housing 28 and opening 42 extends through side wall 44 of housing 32.

Spring member 46, located in channel 30, comprises leaf spring 48 and attached push button 50 which extends through opening 38 of housing 28. Spring member 52, located in channel 34, comprises leaf spring 54 and attached push button 56 which extends through opening 42 of housing 32.

Female clip member 58 comprises base section 60 attached to a near distal end 102 of elongated tool handle 100. See FIG. 12. Frame member 62 extends up from the base and comprises side wall 64 with opening 66 therethrough, side wall 68 with opening 70 therethrough, and top wall 72 from which tab 74 downwardly extends. Spiral spring member 76 is located within space 78 formed within frame member 62. Spring member 76 extends up from base 60 and is circumscribed by frame member 62.

For routine cleaning, male clip member 22 is configured to be received, maintained, and secured within female clip member 58 as follows. Male clip member 22 is first positioned over female clip member 58 such that its slot 36 is aligned with tab 74. See FIG. 10. Push buttons 50 and 56, located in openings 38 and 42, are pushed towards each other so they are almost flush with side walls 40 and 44 of housings 28 and 32 of male clip member 22. Housings 28 and 32 and slot 36 are then inserted into space 78 over tab 74 of female clip member 58, against the bias of spiral spring member 76. As male clip member 22 continues to be inserted into space 78, the bias of leaf springs 48 and 54 compels push buttons 50 and 56 outward, into and through openings 66 and 70 in side walls 64 and 68 of frame member 62, while the bias of spiral spring member 76 acts against housing 28 and 32; thus rigidly securing male clip member 22 within female clip member 58 and, hence, handle 100.

A variety of cleaning elements can be secured to surface 25 of main body section 24 of male clip member 22. Male clip member 22 with scrub brush bristles 26 secured to and extending from surface 25 of main body section 24, becomes a separable tool head accessory. In like manner, other cleaning elements, such as but not limited to, sponge members, scrub pads, dustpans, shovels, scrappers, bulb-changing devices, and squeegees can be secured to the main body section of a male clip member, potentially creating a multitude of tool head accessories.

A tool head accessory which is attached to female clip member 58 can easily and quickly be removed from handle 100 by simply pressing push buttons 50 and 56 of male clip member inward, toward each other, against the bias of leaf springs 48 and 54, so that they are withdrawn from within openings 66 and 70. The bias of spiral spring member 76 then compels male clip member 22 up and out of space 78 and female clip member 58. Male clip member can then be lifted up and away from handle 100. An alternate tool head accessory having a different male clip member 22 can then be secured within female clip member 58 and to handle 100.

In this manner, a number of tool head accessories are provided for use with a single handle, each available to be interchanged depending on the desire and requirements of the user.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A tool head clamping system for a hand tool having an elongated handle and a tool head accessory, said system comprising:

a male clip member comprising a main body section, first and second enclosed housings extending out from the main body section, a first enclosed channel extending through the first housing and a second enclosed channel extending through the second housing, a first U-shaped leaf spring located within the first channel, and a second U-shaped leaf spring located within the second channel, the first and second leaf springs at all times remaining biased in their respective channels as components of the male clip member; and a female clip member comprising a base secured to the distal end of an elongated handle, a frame member extending up from the base, said frame member having upstanding first and second side walls, a front wall, and a rear wall, said walls defining an interior chamber within the frame member, the walls circumscribing a spiral spring which extends up from the base, within the chamber;

wherein the frame member of the female clip member is configured to receive and maintain the channels of the male clip member to engage and secure the male clip member to the distal end of the elongated handle by the biasing of the first and second leaf springs within the frame member and the biasing of the spiral spring against the male clip member, and wherein when the male clip member and the female clip member are disengaged and then separated from each other, the first and second leaf springs remain in their respective channels.

2. The tool head clamping system as in claim 1 wherein a slot is located between the first and second channels and wherein the frame member of the female clip member has a top wall from which a tab downwardly extends, the tab being configured to be positioned within the slot when the channels of the male clip member are maintained on the frame member.

3. The tool head clamping system as in claim 1 wherein the first leaf spring is attached at its end to a first push button which extends through an opening in the first housing and the second leaf spring is attached at its end to a second push button which extends through an opening in the second housing.

4. The tool head clamping system as in claim 3 wherein the first and second side walls, each have an opening therethrough, the first push button being configured to extend through the opening in the first side wall and the second push button being configured to extend through the opening in the second side wall.

5. The tool head clamping system as in claim 1 wherein a slot is located between the first and second channels and wherein the rear wall of the frame member of the female clip member has an outwardly extending tab, the tab being configured to be positioned within the slot when the channels of the male clip member are maintained on the frame member.

6. The tool head clamping system as in claim 5 wherein the first leaf spring is attached at its end to a first push button which extends through an opening in the first housing and the second leaf spring is attached at its end to a second push button which extends through an opening in the second housing.

7. The tool head clamping system as in claim 5 wherein the first and second side walls each have an opening therethrough, the first push button being configured to extend through the opening in the first side wall and the second push button being configured to extend through the opening in the second side wall.

8. The tool head clamping system as in claim 1 wherein a cleaning element is secured to the male clip member, creating a separable tool head accessory.

9. The tool head clamping system as in claim 8 wherein the cleaning element comprises scrub brush bristles.

* * * * *